US011319746B2

(12) United States Patent
Pluff

(10) Patent No.: US 11,319,746 B2
(45) Date of Patent: May 3, 2022

(54) SECURITY DOOR SYSTEM

(71) Applicant: Detroit Glass and Door, LLC, Warren, MI (US)

(72) Inventor: Christopher Charles Pluff, Detroit, MI (US)

(73) Assignee: Detroit Glass and Door, LLC, Warren, MI (US)

( * ) Notice: Subject to any disclaimer, the term of this patent is extended or adjusted under 35 U.S.C. 154(b) by 199 days.

(21) Appl. No.: 16/448,219

(22) Filed: Jun. 21, 2019

(65) Prior Publication Data

US 2020/0399951 A1 Dec. 24, 2020

(51) Int. Cl.

| | |
|---|---|
| ***E06B 5/11*** | (2006.01) |
| ***E06B 3/88*** | (2006.01) |
| ***E06B 7/36*** | (2006.01) |

(52) U.S. Cl.

CPC ..... *E06B 5/113* (2013.01); *E06B 3/88* (2013.01); *E06B 7/36* (2013.01)

(58) Field of Classification Search

CPC ... E06B 5/113; E06B 3/88; E06B 7/36; E05B 15/0205; E05B 17/2084

See application file for complete search history.

(56) References Cited

U.S. PATENT DOCUMENTS

| | | | | |
|---|---|---|---|---|
| 3,271,063 | A * | 9/1966 | Garrett | E06B 5/113 292/346 |
| 4,725,084 | A * | 2/1988 | Catricola | E05B 17/2003 292/346 |
| 5,335,450 | A | 8/1994 | Procton | |
| 5,590,919 | A | 1/1997 | Germano | |
| 5,630,302 | A * | 5/1997 | Rosenband | E04H 1/1266 52/204.1 |
| 6,088,966 | A * | 7/2000 | Kenkel | E05D 11/0054 49/383 |
| 6,622,432 | B2 * | 9/2003 | Zacher | E06B 3/88 49/401 |
| 7,513,539 | B2 | 4/2009 | Phipps | |
| 7,694,471 | B2 | 4/2010 | Meeks et al. | |
| 7,788,863 | B2 | 9/2010 | Pepper et al. | |
| 7,878,559 | B2 | 2/2011 | Meeks et al. | |

(Continued)

FOREIGN PATENT DOCUMENTS

| | | | | |
|---|---|---|---|---|
| CA | 2135444 | A1 * | 5/1996 | E06B 5/113 |
| CA | 2483889 | A1 | 4/2006 | |

(Continued)

*Primary Examiner* — Marcus Menezes
(74) *Attorney, Agent, or Firm* — Brooks Kushman P.C.

(57) ABSTRACT

A security door system includes a door frame, a door, and an astragal. The door frame has first and second vertically extending side members that define an opening therebetween. The door is disposed within the opening and is secured to the frame via a hinged connection along the first vertically extending side member. A gap is defined between an edge of the door, that is opposite the hinged connection, and the second vertically extending side member when the door is in a closed position. The astragal has first and second plates that are secured to an outer surface of the door. The first plate extends beyond the edge such that the first plate covers the gap when the door is in the closed position. The second plate extends from the first plate in a direction away from the edge and toward the hinged connection.

14 Claims, 2 Drawing Sheets

(56) References Cited

U.S. PATENT DOCUMENTS

| | | | | |
|---|---|---|---|---|
| 8,522,479 | B2 | 9/2013 | Massey et al. | |
| 8,627,610 | B1 * | 1/2014 | Crowther | E04H 1/1266 52/32 |
| 9,074,392 | B2 | 7/2015 | Berger | |
| 9,163,441 | B1 | 10/2015 | Taylor, III | |
| 9,316,041 | B2 | 4/2016 | Olson et al. | |
| 9,803,413 | B2 | 10/2017 | MacDonald | |
| 10,823,485 | B2 * | 11/2020 | Lv | F25D 23/025 |
| 2003/0041410 | A1 * | 3/2003 | Morgan | E06B 5/113 16/49 |
| 2005/0011132 | A1 * | 1/2005 | Griffin, Jr. | E06B 5/113 49/460 |
| 2005/0198910 | A1 * | 9/2005 | Keller | E06B 3/70 49/501 |
| 2010/0064585 | A1 | 3/2010 | Gertz | |
| 2010/0107503 | A1 | 5/2010 | Chapman | |
| 2014/0366455 | A1 * | 12/2014 | Helton | E06B 5/10 49/483.1 |
| 2018/0119480 | A1 * | 5/2018 | Fields, I | E05B 17/2084 |
| 2018/0258684 | A1 | 9/2018 | MacDonald et al. | |
| 2020/0392755 | A1 * | 12/2020 | Lai | E05B 9/002 |

FOREIGN PATENT DOCUMENTS

| | | | | |
|---|---|---|---|---|
| DE | 102015012161 | A1 * | 3/2017 | E06B 5/113 |
| EP | 2990580 | A1 * | 3/2016 | E06B 5/113 |
| FR | 928984 | A * | 12/1947 | E06B 5/113 |
| NL | 1008907 | C2 * | 10/1999 | E06B 3/88 |
| WO | WO-0161132 | A2 * | 8/2001 | E05B 63/242 |

* cited by examiner

SECURITY DOOR SYSTEM

TECHNICAL FIELD

The present disclosure relates to security door systems that are configured prevent someone from breaking into a building.

BACKGROUND

Buildings may include security door systems that are configured to prevent criminals from breaking into the buildings.

SUMMARY

A security door system includes a door frame, a door, and an astragal. The door frame has first and second vertically extending side members that define an opening therebetween. The door is disposed within the opening and is secured to the frame via a hinged connection along the first vertically extending side member. A gap is defined between an edge of the door, that is opposite the hinged connection, and the second vertically extending side member when the door is in a closed position. The astragal has first and second plates that are secured to an outer surface of the door. The first plate extends beyond the edge such that the first plate covers the gap when the door is in the closed position. The second plate extends from the first plate in a direction away from the edge and toward the hinged connection.

A security astragal for a door includes a vertically extending plate and a horizontally extending plate. The vertically extending plate is configured to cover a gap defined between an edge of the door, that is opposite a hinge, and a door frame when the door is in the closed position. The horizontally extending plate protrudes from the vertically extending plate in a direction away from the edge and toward the hinge.

A security door system includes a door frame, a door, and an astragal. The door frame defines an opening. The door is disposed within the opening and is secured to the frame via a hinged connection along a first edge of the door. A gap is defined between a second edge of the door, that is opposite the first edge, and the door frame when the door is in a closed position. The astragal is secured to an outside surface of the door between the first and second edges. The astragal has a vertically extending plate and a horizontally extending plate. The vertically extending plate extends beyond the second edge and covers the gap when the door is in the closed position. The horizontally extending plate extends from the vertically extending plate in a direction away from the second edge and toward the first edge.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
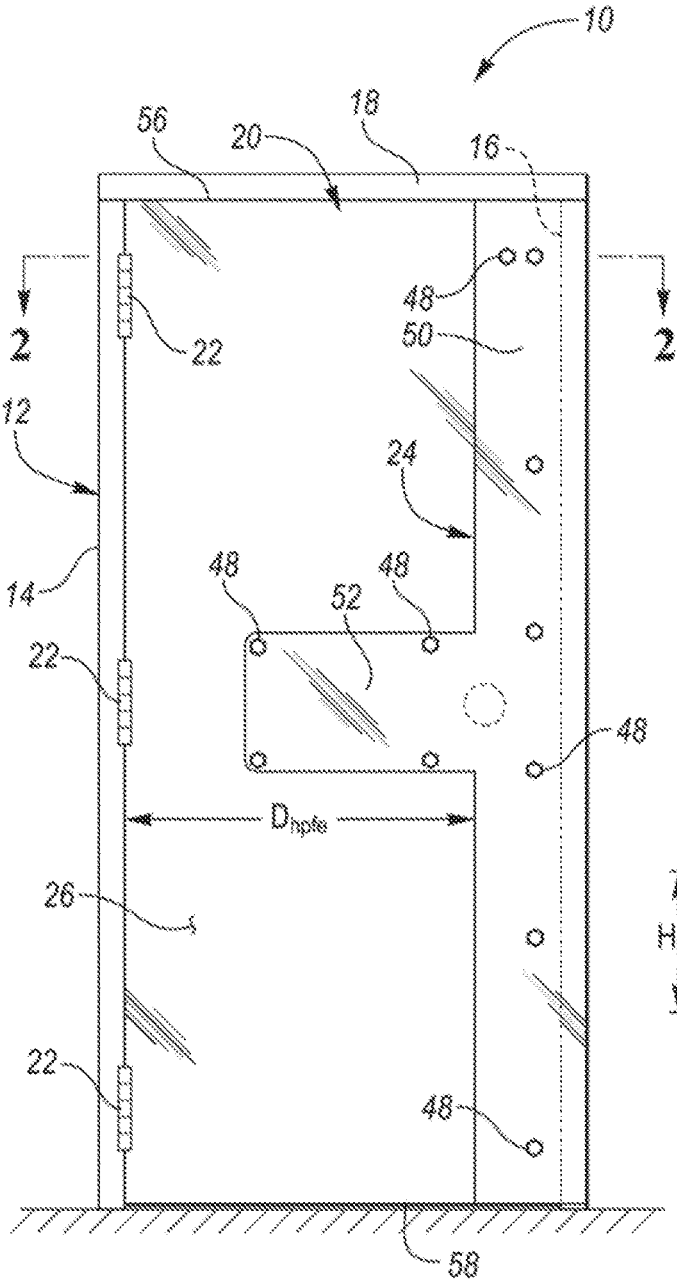
FIG. 1 is a front view of a security door system that is configured to prevent someone from breaking into a building.

Referring to FIG. 1, a front view of a security door system 10 that is configured to prevent someone from breaking into a building is illustrated. The security door system 10 includes a door frame 12. The door frame includes a first vertically extending side member 14 and a second vertically extending side member 16. The top of the first vertically extending side member 14 and the top of the second vertically extending side member 16 are connected to each other by a horizontally extending cross-member 18. The first vertically extending side member 14, the second vertically extending side member 16, and the horizontally extending cross-member 18 define an opening. More specifically, the opening is defined between the first vertically extending side member 14 and the second vertically extending side member 16.

A door 20 is disposed within the opening. The door 20 is secured to the door frame 12 by a hinged connection such that the door 20 is disposed within the opening when in a closed position and such that access to the opening is provided when the door 20 is in an open position. The hinged connection may include one or more hinges 22 that secure a first edge of the door 20 to the first vertically extending side member 14 of the door frame 12. The door 20 is configured to pivot along hinges 22 between the open and closed positions. An astragal 24 is secured to a first outside surface or first outer surface 26 of the door 20. The astragal 24 is configured to cover a gap between the door 20 and the door frame 12 when the door 20 is in the closed position. More specifically, the astragal 24 is configured to cover the gap between the door 20 and the door frame 12 when the door 20 is in the closed position in order to prevent a tool, such as crowbar, from being inserted into the gap between the door 20 and the door frame 12 for the purposes of prying the door open, which is a common technique utilized by criminals for breaking into buildings.

Figure 2:
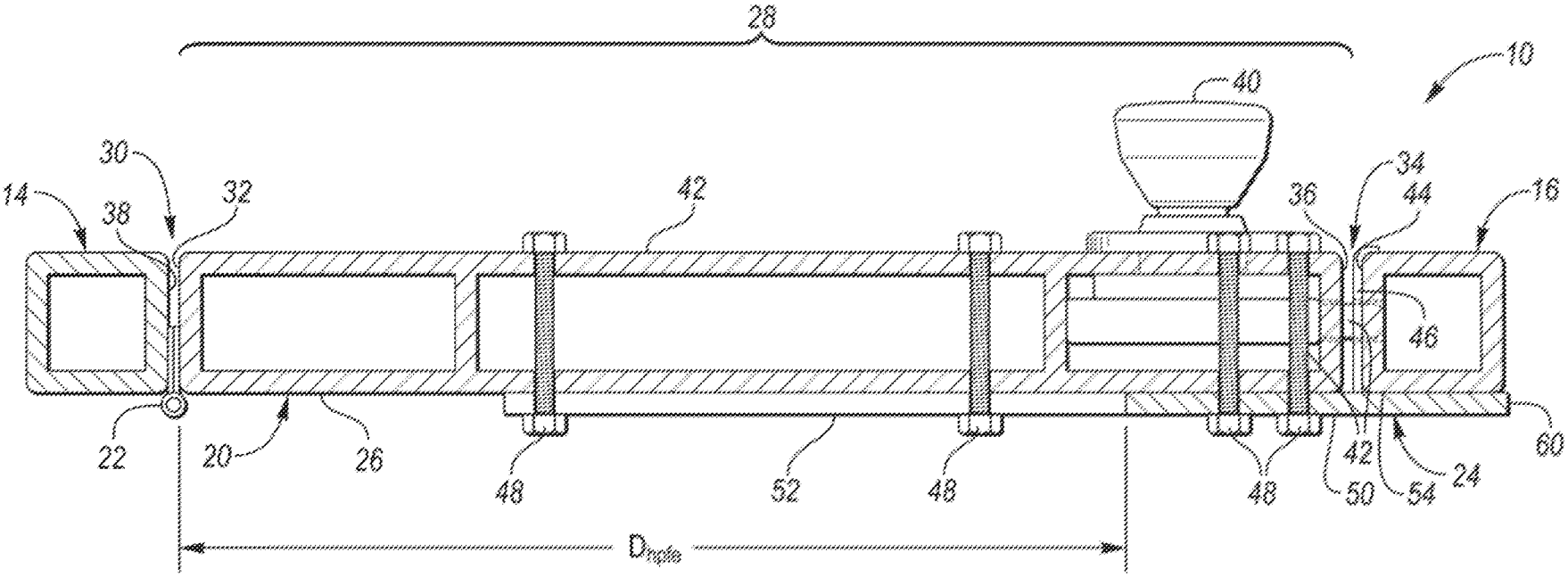
FIG. 2 is a cross-sectional view of the security door system taken along line 2-2 in FIG. 1.

Referring now to FIGS. 1 and 2, the front view of the security door system and a cross-sectional view of the security door system taken along line 2-2 in FIG. 1 are illustrated, respectively. The door 20 is shown to be disposed within the opening 28 that is defined between the first vertically extending side member 14 and the second vertically extending side member 16 of the door frame 12 in both FIGS. 1 and 2. The door 20 is also depicted in the closed position in both FIGS. 1 and 2. In FIG. 1 the door 20 is configured to open along the hinges 22 in a direction that is out of the paper and toward an observer of FIG. 1. In FIG. 2 the door 20 is configured to open along the hinges 22 in a downward direction with respect to the orientation of FIG. 2.

A first gap 30 is defined between a first edge 32 (or first external sidewall) of the door 20 and the first vertically extending side member 14 of the frame 12 when the door 20 is in the closed position. A second gap 34 is also defined between a second edge 36 (or second external sidewall) of the door 20 and the second vertically extending side member 16 of the frame 12 when the door 20 is in the closed position. The second gap 34 and the second edge 36 are defined and disposed, respectively, on an opposing side of the door 20 relative to the hinged connection (i.e., on an opposite side of the door 20 relative to the hinges 22, first gap 30, and first edge 32). The hinges 22 secure the first edge 32 of the door 20 to the first vertically extending side member 14 of the frame 12. The hinges 22 more specifically secure the first edge 32 of the door 20 to an internal sidewall 38 of the first vertically extending side member 14 of the frame 12.

A door handle 40 protrudes from a second outside surface or second outer surface 42 of the door 20. The second outer surface 42 of the door 20 and the first outer surface 26 of the door 20 may be opposing (i.e., opposite) surfaces. The first outer surface 26 of the door 20 may be an external surface or an external wall of the door 20 that is meant to face an exterior of building that the door 20 is secured to. The second outer surface 42 of the door 20 may be an internal surface or an internal wall of the door 20 that is meant to face an interior of building that the door 20 is secured to. Since a door handle 40 is only located on the inside surface (i.e., the second outer surface 42) of the door 20, the door 20 may only be operated to exit and not to enter the building that the door 20 is secured to. The door handle 40 may be linked to a lock and latching mechanism 42 that is configured to engage the vertically extending side member 16 to latch and/or lock the door 20 in the closed position within the door frame 12. More specifically, the lock and latching mechanism 42 may engage an internal sidewall 44 of the second vertically extending side member 16 of the frame 12 or may engage a striker plate 46 that is secured to the internal sidewall 44 of the second vertically extending side member 16 in order to latch and/or lock the door 20 in the closed position within the door frame 12.

The astragal 24 is secured to the first outer surface 26 of the door 20 between the first edge 32 and the second edge 36 of the door 20. More specifically, the astragal 24 may be secured to the first outer surface 26 of the door 20 by a plurality of fasteners 48. The fasteners 48 may be bolts, screw, rivets, etc. The fasteners 48 may be self-piercing. The fasteners 48 may be one-way type fasteners that may installed by a tool such as a rivet gun or screw driver but require a more difficult process, such as drilling, for removal after installation. For example, the fasteners 48 may be clutch head type fasteners or may be rivets with rounded heads that do not include slots or some other feature for an engaging tool such as a screw driver. Alternatively, the fasteners 48 may extend through the door 20 and engage a nut and washer to secure the astragal 24 to the door 20. The purpose of the astragal 24 is to ultimately prevent someone from breaking into a building via the door 20 by covering the second gap 34 between the door 20 and the door frame 12 in order to prevent a tool, such as crowbar, from being inserted into the second gap 34. Therefore, it may also be advantageous to secure the astragal 24 to the door 20 via one-way type fasteners to prevent the easy removal of the astragal 24 itself.

The astragal 24 has a vertically extending plate 50 and a horizontally extending plate 52. The vertically extending plate 50 and the horizontally extending plate 52 may be referred to as the first and second plates, respectively. The vertically extending plate 50 extends beyond the second edge 36 of the door 20 and covers the second gap 34 when the door 20 is in the closed position. More specifically, the vertically extending plate 50 may extend beyond the second gap 34 such that the vertically extending plate 50 also covers a portion of or all of an outside wall 54 of the second vertically extending side member 16 of the door frame 12. The vertically extending plate 50 may extend beyond the second edge 36 of the door 20 along the entire vertical length of the door 20 (i.e., from a top 56 to a bottom 58 of the door 20) and the vertical length of second vertically extending side member 16 that is adjacent to the door 20 in order to completely cover the second gap 34 between the door and the second vertically extending side member 16 of the door frame 12.

The horizontally extending plate 52 extends from the vertically extending plate 50 in a direction away from the second edge 36 and toward the first edge 32 and the hinged connection (i.e., the hinges 22). The purpose of the horizontally extending plate 52 is to extend the overall horizontal length of the astragal 24, allowing the astragal 24 to provide a larger reaction force and bending moment in the event a tool, such a crowbar, is applied to an outer edge 60 of the vertically extending plate 50 in an attempt to pry the door 20 open or in an attempt to pry the astragal away from the first outer surface 26 of the door 20. The vertically extending plate 50 and the horizontally extending plate 52 form a single component (i.e., the astragal 24). The vertically extending plate 50 and the horizontally extending plate 52 may be formed from a single stock component or may be joined together by any known process, such as welding. The vertically extending plate 50 and the horizontally extending plate 52 may be coplanar.

Figure 3:
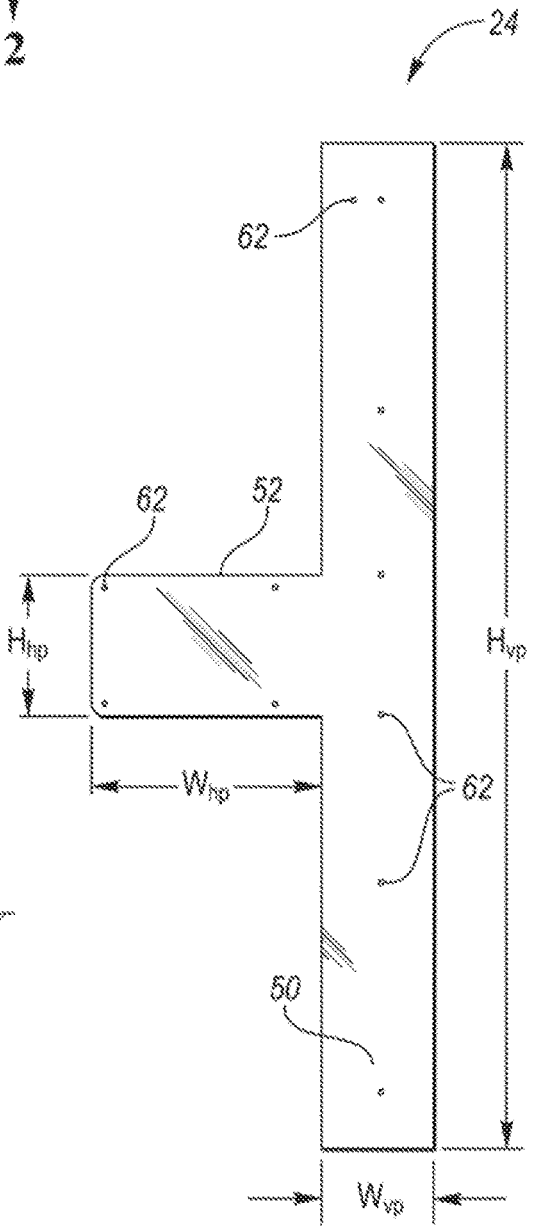
FIG. 3 is a front view of an astragal that is part of the security door system depicted in FIGS. 1 and 2.

Referring to FIG. 3, a front view of the astragal 24 is illustrated. The astragal 24 may define a plurality of orifices 62 that are configured to receive the fasteners 48. More specifically, the fasteners 48 may extend through the orifices 62 and engage the first outer surface 26 of the door 20 in order to secure the astragal 24 to the door 20. The vertically extending plate 50 has a height, $H_{vp}$, and a width, $W_{vp}$. A ratio of the height, $H_{vp}$, of the vertically extending plate 50, to the width, $W_{vp}$, of the vertically extending plate 50 may have a value that ranges between 5 to 1 and 15 to 1. The horizontally extending plate 52 has a height, $H_{hp}$, and a width, $W_{hp}$. A ratio of the height, $H_{hp}$, of the horizontally extending plate 52 to the width, $W_{hp}$, of the horizontally extending plate 52 may have a value that ranges between 1 to 4 and 1 to 1. A ratio of the height, $H_{vp}$, of the vertically extending plate 50 to the width, $W_{hp}$, of the horizontally extending plate 52 may have a value that ranges between 3 to 1 and 5 to 1.

Referring now to FIG. 1, the horizontally extending plate 52 of the astragal 24 extends a portion of the distance, $D_{hpfe}$, from the vertically extending plate 50 to the first edge 32. More specifically, the horizontally extending plate 52 of the astragal 24 spans between 25% and 75% of the distance, $D_{hpfe}$, from the vertically extending plate 50 to the first edge 32.

It should be understood that the designations of first, second, third, fourth, etc. for gaps, edges, plates, surfaces, side members, etc., or any other component, state, or condition described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A security door system comprising:

a door frame having first and second vertically extending side members that define an opening therebetween;

a door (i) disposed within the opening, (ii) secured to the frame via a hinged connection along the first vertically extending side member, (iii) having a handle disposed on first outer surface of the door, and (iv) having an absence of a handle on a second outer surface of the door that is opposite the first outer surface of the door, wherein a gap is defined between an edge of the door, that is opposite the hinged connection, and the second vertically extending side member when the door is in a closed position; and an astragal having first and second plates that are secured to the second outer surface of the door, the first plate extending (i) horizontally from a position overlapping the handle to beyond the edge such that the first plate covers the gap when the door is in the closed position and (ii) extending vertically from a top to a bottom of the door, the second plate (i) secured to and extending horizontally from a middle region of the first plate in a direction away from the edge and toward the hinged connection such that the second plate and the middle region of the first plate collectively extend across at least half the width of the door, (ii) having upper and lower edges that are disposed below and above the top and bottom of the door, respectively, and (iii) is configured to provide a reaction force in response to a prying force to remove the first plate from the door, wherein the first and second plates form a T-shape.

2. The security of door system of claim 1, wherein the second plate spans between 25% and 75% of a distance between the first plate and the hinged connection.

3. The security door system of claim 1, wherein the first and second plates are coplanar.

4. The security door system of claim 1, wherein the first plate has a height to width ratio that ranges between 5:1 and 15:1.

5. The security door system of claim 1, wherein the second plate has a height to width ratio that ranges between 1:4 and 1:1.

6. The security of door system of claim 1, wherein the astragal vertically and horizontally overlaps the door handle.

7. The security of door system of claim 1, wherein the door frame further comprises a horizontally extending cross-member extending between the first and second vertically extending side members along a top of the door frame, and wherein the first plate extends vertically from the bottom of the door to a lower edge of the horizontally extending cross-member.

8. A security door system comprising:

a door frame defining an opening;

a door (i) disposed within the opening, (ii) secured to the frame via a hinged connection along a first edge of the door, (iii) having a handle disposed on a first side of the door proximate a second edge of the door that is opposite the first edge, and (iv) having an absence of a handle on a second side of the door that is opposite the first side of the door, wherein a gap is defined between the second edge of the door and the door frame when the door is in a closed position; and an astragal secured to an outside surface on the second side of the door between the first and second edges, the astragal having a vertically extending plate and a horizontally extending plate, wherein the vertically extending plate extends (i) horizontally from a position overlapping the handle to beyond the second edge such that the vertically extending plate covers the gap when the door is in the closed position and (ii) extends vertically from a top to a bottom of the door, and wherein the horizontally extending plate (i) is secured to and extends horizontally from the a middle region of the vertically extending plate in a direction away from the second edge and toward the first edge such that the horizontally extending plate and the middle region of the vertically extending plate collectively extend across at least half the width of the door, (ii) has upper and lower edges that are disposed below and above the top and bottom of the door, respectively, and (iii) is configured to provide a reaction force in response to a prying force to remove the vertically extending plate from the, door, wherein the vertically extending plate and the horizontally extending plate form a T-shape.

9. The security of door system of claim 8, wherein the horizontally extending plate spans between 25% and 75% of a distance between the vertically extending plate and the first edge.

10. The security door system of claim 8, wherein the vertically extending plate and horizontally extending plate are coplanar.

11. The security door system of claim 8, wherein the vertically extending plate has a height to width ratio that ranges between 5:1 and 15:1.

12. The security door system of claim 8, wherein the horizontally extending plate has a height to width ratio that ranges between 1:4 and 1:1.

13. The security of door system of claim 8, wherein the astragal vertically and horizontally overlaps the door handle.

14. The security of door system of claim 8, wherein the vertically extending plate extends vertically from the bottom of the door to a lower edge of an upper cross-member of the door frame.

* * * * *